US009415295B2

(12) United States Patent
Braden et al.

(10) Patent No.: US 9,415,295 B2
(45) **Date of Patent: *Aug. 16, 2016**

(54) SKATEBOARD TRUCK ASSEMBLY

(71) Applicant: BRADEN BOARDS, LLC, Hollister, MO (US)

(72) Inventors: Jared Braden, Hollister, MO (US); Roger Braden, Hollister, MO (US)

(73) Assignee: Braden Boards LLC, Hollister, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/663,942

(22) Filed: Mar. 20, 2015

(65) Prior Publication Data

US 2015/0190703 A1 Jul. 9, 2015

Related U.S. Application Data

(63) Continuation of application No. 13/288,287, filed on Nov. 3, 2011, now Pat. No. 9,010,777.

(51) Int. Cl.

| | |
|---|---|
| ***A63C 17/01*** | (2006.01) |
| ***A63C 17/02*** | (2006.01) |
| ***A63C 17/26*** | (2006.01) |
| ***A63C 17/00*** | (2006.01) |

(52) U.S. Cl.

CPC ..... *A63C 17/012* (2013.01); *A63C 17/0046* (2013.01); *A63C 17/015* (2013.01); *A63C 17/017* (2013.01); *A63C 17/265* (2013.01)

(58) Field of Classification Search

CPC .. A63C 17/012; A63C 17/015; A63C 17/017; A63C 17/0046; A63C 17/0093; B62B 3/007

USPC ..... 280/87.041–87.043, 87.05, 11.28

See application file for complete search history.

(56) References Cited

U.S. PATENT DOCUMENTS

| | | | | |
|---|---|---|---|---|
| 255,460 | A * | 3/1882 | Ross | 280/11.28 |
| 299,799 | A * | 6/1884 | Kindblade | 280/7.13 |
| 2,494,019 | A * | 1/1950 | Ware, Jr. | 280/11.28 |
| 2,763,490 | A * | 9/1956 | Crone | 280/11.28 |
| 2,920,899 | A * | 1/1960 | Crone | 280/11.28 |
| 3,891,225 | A * | 6/1975 | Sessa | 280/11.19 |
| 4,071,256 | A * | 1/1978 | Kimmell | 280/11.28 |
| 4,245,848 | A * | 1/1981 | Dudouyt | 280/11.28 |
| 4,251,087 | A * | 2/1981 | Hansen | 280/11.28 |
| 4,311,319 | A * | 1/1982 | Snyder et al. | 280/11.28 |
| 4,799,702 | A * | 1/1989 | Wang | 280/87.041 |
| 5,183,277 | A * | 2/1993 | Tang | 280/11.28 |
| 5,853,182 | A * | 12/1998 | Finkle | 280/87.042 |
| 6,315,312 | B1 * | 11/2001 | Reyes et al. | 280/87.042 |
| 6,428,023 | B2 * | 8/2002 | Reyes et al. | 280/87.042 |
| 6,474,666 | B1 * | 11/2002 | Andersen et al. | 280/87.041 |
| 6,523,837 | B2 * | 2/2003 | Kirkland | 280/11.28 |
| 7,219,907 | B2 * | 5/2007 | Chang | 280/87.042 |
| 7,316,408 | B2 * | 1/2008 | McClain | 280/87.042 |

(Continued)

*Primary Examiner* — Joseph Rocca
*Assistant Examiner* — Travis Coolman
(74) *Attorney, Agent, or Firm* — Shook, Hardy & Bacon, L.L.P.

(57) ABSTRACT

A skateboard truck assembly comprising a base plate, a hanger, and at least one compressible member interposed there between that utilizes rotation of the hanger to at least partially and temporarily deform the compressible member, thereby creating zones of tension and/or compression within the compressible member and facilitating smooth and efficient motion of the skateboard.

20 Claims, 9 Drawing Sheets

(56) References Cited

U.S. PATENT DOCUMENTS

| | | | | |
|---|---|---|---|---|
| 7,374,179 | B2 * | 5/2008 | Cole | 280/11.27 |
| 7,413,200 | B2 * | 8/2008 | Horn | 280/87.042 |
| 8,328,206 | B2 * | 12/2012 | Williams, Jr. | 280/11.28 |
| 2002/0195788 | A1 * | 12/2002 | Tierney et al. | 280/87.042 |
| 2003/0122334 | A1 * | 7/2003 | Laporte | 280/87.041 |
| 2006/0097470 | A1 * | 5/2006 | Chmelar | 280/87.042 |
| 2012/0161409 | A1 * | 6/2012 | Young | 280/87.042 |
| 2013/0069331 | A1 * | 3/2013 | Yamada | 280/87.042 |

* cited by examiner

SKATEBOARD TRUCK ASSEMBLY

CROSS-REFERENCE TO RELATED APPLICATIONS

This application is a Continuation application of co-pending U.S. application Ser. No. 13/288,287, filed Nov. 3, 2011 and entitled "Skateboard Truck Assembly." The entirety of this application is incorporated herein by reference.

STATEMENT REGARDING FEDERALLY SPONSORED RESEARCH OR DEVELOPMENT

Not applicable.

TECHNICAL FIELD

This invention generally relates to a skateboard truck assembly that utilizes rotational motion to facilitate maneuverability of a skateboard. In another aspect, the invention relates to a skateboard employing one or more inventive truck assemblies.

BACKGROUND OF THE INVENTION

In addition to securing the wheels of a skateboard to its deck, the skateboard truck assembly plays an important role in the overall maneuverability of the skateboard, including, in particular, the rider's ability to control the direction of the board's travel. Several types of skateboard trucks exist and its ultimate design is subject to significant variation. However, in general, most truck assemblies tend to operate on the basic principle that a change in the rider's position on the board (e.g., through a shift in weight or "pumping" one's legs) can be at least partially translated to a change in the direction of the skateboard's motion. Many conventional truck assemblies, however, exhibit a variety of drawbacks that can adversely impact the operation of the skateboard both in terms of rider flexibility and performance and, in some cases, rider safety. For example, conventional trucks place an extreme amount of stress on the reverse kingpin, which can oftentimes result in failed or broken parts. This creates a hazardous situation for the rider. In addition, many traditionally-designed skateboard trucks geometrically limit the skateboard's turning ability, which is the method used to slow the skateboard down when riding on uneven or sloped (e.g., mountainous) terrain. Conventional trucks can only exhibit a tighter turning radius when the truck is loosened, which consequently reduces stability, especially at high speeds. This is extremely dangerous, as it can cause "speed wobble," which can result in severe injury or even death. Thus, a need exists for a robust, yet versatile, skateboard truck design that maximizes the turning ability and performance of the skateboard, while retaining a suitable degree of stability and, ultimately, enhancing both rider control and safety.

BRIEF SUMMARY OF THE INVENTION

One embodiment of the present invention concerns a skateboard truck assembly comprising a base plate, a hanger, and at least one compressible member. The base plate is configured to be mounted on a skateboard deck and the hanger is configured to at least partially rotate about an axis between a resting position and a turning position. The at least one compressible member is at least partially interposed between the hanger and the base plate, and the rotation of the hanger away from the resting position creates at least one compression zone and at least one tension zone in the compressible member.

Another embodiment of the present invention concerns a skateboard comprising a deck and a pair of truck assemblies coupled to the deck. Each of the truck assemblies comprises a base plate, a kingpin, a hanger, and at least one compressible member. The base plate is configured to be mounted to the deck and the hanger is configured to at least partially rotate about the kingpin between a resting position and a turning position. The at least one compressible member is at least partially interposed between the hanger and the base plate and the rotation of the hanger away from the resting position creates at least one compression zone and at least one tension zone in the compressible member.

BRIEF DESCRIPTION OF THE SEVERAL VIEWS OF THE DRAWINGS

Various embodiments of the present invention are described in detail below with reference to the attached drawing figures, wherein.

DETAILED DESCRIPTION OF THE INVENTION

Figures 1, 2:
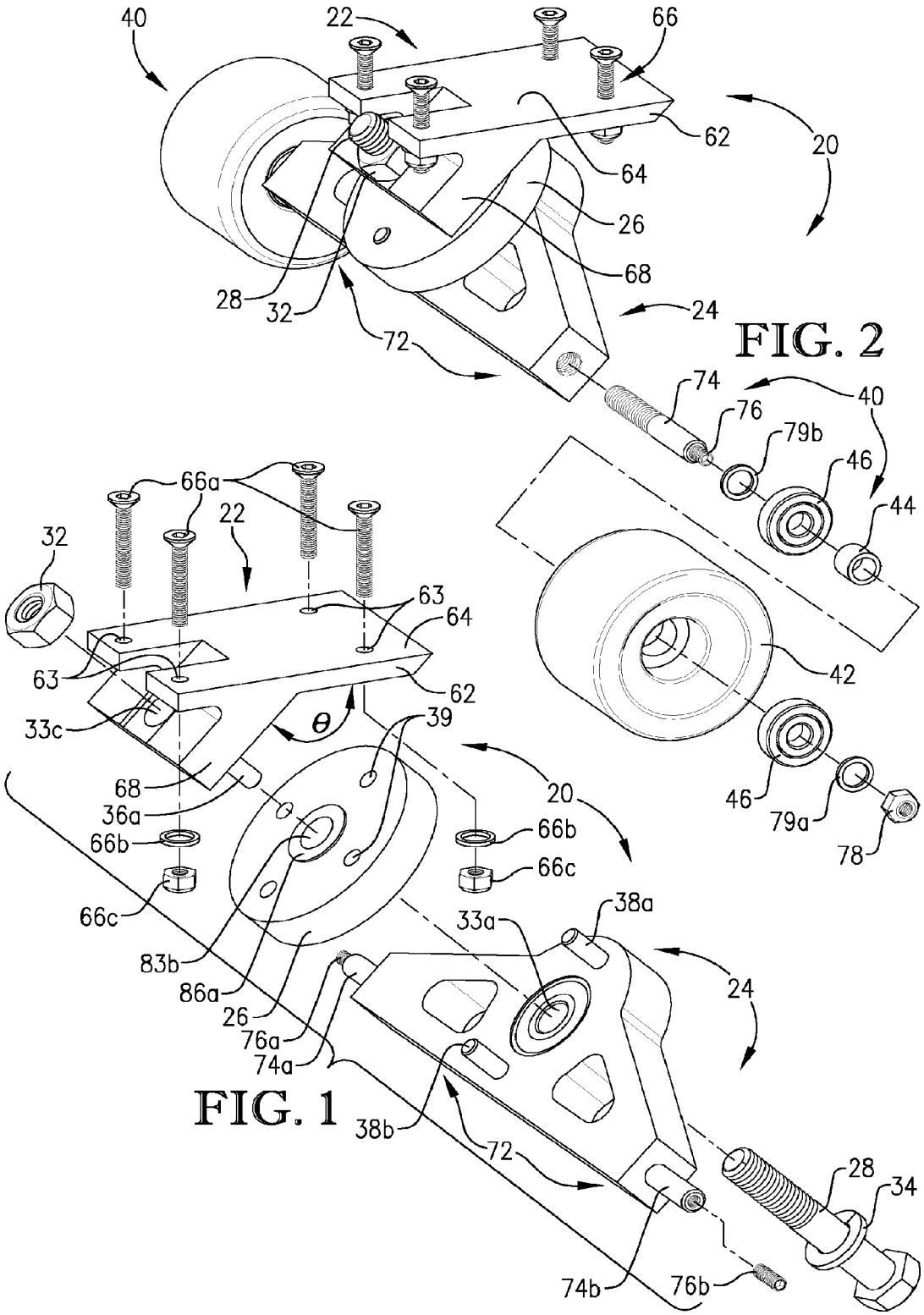
FIG. 1 is an isometric assembly view of a skateboard truck that does not include a wheel.
FIG. 2 is an isometric assembly view of a skateboard truck that additionally provides an assembly view of a wheel.

Referring now to the Figures in more detail, like numerals indicate like parts in all views. Turning initially to FIGS. 1-7, a skateboard truck assembly 20, configured according to one or more embodiments of the present invention, is provided. Truck assembly 20 can be operable to fasten or attach at least one wheel assembly 40 to a skate deck 30 of a skateboard 10. In addition, truck assembly 20 can also function as a turning mechanism, at least partially facilitating the transfer of rider-generated energy into motion and, in particular, directional motion, of skateboard 10, which will be discussed in detail shortly with respect to FIGS. 8-14.

Turning initially to FIGS. 1-7, skateboard truck assembly 20 comprises a base plate 22, a hanger 24, and at least one compressible member 26 at least partially interposed between base plate 22 and hanger 24. Base plate 22 can be configured to be mounted to a skate deck 30 via a mounting plate 62, which presents a substantially planar interface surface 64 configured to interface with the underside of skate deck 30. Although illustrated in FIGS. 1-7 as mounting to the underside of skate deck 30, it should be understood that, in some embodiments, skateboard truck assembly 20 and, in particular, base plate 22, can be configured to be at least partially mounted onto the upper surface of deck 30, such as, for example, when truck assembly 20 comprises a drop-down truck. In one embodiment (not shown), wherein truck assembly 20 comprises a drop-down truck, deck 30 can define one or more openings into which truck assembly 20 may be inserted and at least a portion of truck assembly 20 can then be configured to be mounted to an upper surface of skate deck 30. In another embodiment depicted in FIGS. 1-7, mounting plate 62 of base plate 22 can define a plurality of openings 63, which allows base plate 22 to be secured to deck 30 via a plurality of deck bolt assemblies 66, each of which comprises a deck bolt 66*a*, a washer 66*b*, and a nut 66*c*. Although shown as including four deck bolt assemblies 66, it should be understood that any suitable number of deck bolt assemblies 66 can be used to secure truck assembly 20 to deck 30.

As shown in FIGS. 1-7, base plate 22 can also include an angled hanger coupling member 68 protruding from mounting plate 62 at an angle diverging away from interface surface 64, represented by the angle θ in FIG. 1. In one embodiment, the angle of divergence (θ) can be at least about 90°, at least about 110°, at least about 120°, at least about 135°, or at least about 145°. In contrast to conventional angled truck assemblies, which lose flexibility at the expense of enhanced stability as the divergence angle flattens, truck assemblies configured according to one or more embodiments of the present invention tend to retain flexibility as the angle of divergence approaches 180°.

Compressible member 26 can be a compressible structure, such as, for example, a bushing, that is capable of permitting the movement of hanger 24, as will be described in detail shortly. In one embodiment, generally depicted in FIGS. 1-7, compressible member 26 can be a substantially disc-shaped element having a thickness, represented as "x" in FIG. 3, in the range of from about 0.25 inches to about 2.5 inches, or about 0.5 inches to about 2 inches, although other shapes and/or thicknesses may be contemplated. In some embodiments, compressible member 26 can be made of a material having a Shore A hardness (ASTM D-2244) in the range of from about 60 to about 110, about 70 to about 100, about 75 to about 95, or about 80 to about 90, including, for example, one or more elastomers. Polyurethane is one example of a suitable elastomer from which compressible member 26 can be constructed. According to some embodiments illustrated in FIGS. 1-7, at least a substantial portion of the total volume of compressible member 26 can be completely or almost completely interposed between base plate 22 and hanger 24, while at the same time, can also be substantially exposed, thereby allowing compressible member to free-form as required. This is in contrast to many conventional skate trucks, which include enclosures or housings for encompassing the truck bushing.

Hanger 24 defines an axle 72 for supporting one or more wheel assemblies 40, particularly shown in FIGS. 2-5. Typically, axle 72 is configured to support a pair (e.g., two) of wheel assemblies 40*a,b*, but, in some embodiments, axle 72 and/or hanger 24 can be configured support any suitable number of wheel assemblies, ranging in number, for example, from 1 to 8. Hanger 24 further comprises at least two axle pins (or axle extensions) 74*a,b* threaded into or otherwise fastened onto generally opposing ends of axis 72 and/or hanger 24. In one embodiment, axle pins 74*a,b* can comprise hardened and ground axle pins, rather than the unground, threaded studs often utilized by conventional trucks. Each of axle pins 74 *a,b* can be coupled to a wheel assembly 40 via a respective socket head stud 76 *a,b* and securing nut 78 (with one or more optional washers 79*a,b*), as shown in the Figures.

As particularly illustrated in FIG. 2, each wheel assembly 40 generally includes a wheel 42 and at least one spacer 44 housed by a one or more bearings 46. Bearings 46 can be configured within wheel 42 in any suitable fashion, such as, for example, in a center-set manner (as shown in FIGS. 1-7) or in a side-set or an off-set manner (not shown). Spacer 44 can be made of any suitable material, such as, for example, steel, titanium, plastic, or aluminum, while bearings 46 can generally be made of steel or ceramic. Although illustrated here as comprising bushings, bearings 46 can be any suitable type of bearing or bushing for facilitating smooth rotation of wheel 42, including, for example, ball bearings.

Wheels 42 can be any suitable size and can be selected, at least in part, based on the specific design or desired type of use for skateboard 10. In one embodiment, wheels 42 can be a rounded lip wheel or a square lip wheel and can have a diameter in the range of from about 46 mm to about 56 mm, or from about 48 mm to about 54 mm, while, in other embodiments, wheels 42 can have a diameter in the range of from about 52 mm to about 88 mm, or from about 54 to about 85 mm. In some embodiments, particularly when skateboard 10 comprises a longboard, wheels 42 can have a diameter in the range of from about 60 mm to about 110 mm or from about 65 mm to about 107 mm. The width of wheels 42 can also vary and, in some embodiments, can be in the range of from about 30 mm to about 80 mm or from about 40 mm to about 58 mm. Wheels 42 can be made of any suitable material, including for example, polyurethane or other elastomer, and can have a Shore A hardness (ASTM D-2240) in the range of from 65 to 100, 70 to 95, or 75 to 90.

As shown in FIGS. 1-7, truck assembly 20 can further comprise a kingpin 28 operable to secure, inter alia, compressible member 26 and hanger 24 to base plate 22. As shown in the Figures, each of base plate 22, compressible member 26, and hanger 24 defines therein a respective kingpin opening 33*a-c*, for allowing kingpin 28 to pass through each component. Once assembled, base plate 22, compressible member 26, and hanger 24 can be secured by tightening a kingnut 32 and an optional washer 34 about kingpin 28. As described in further detail below, the motion of hanger 24 can be substantially unaffected by the tightness or looseness of kingnut 32 and/or kingpin 28. This is in contrast to many conventional trucks, whose performance is based, at least in part, on the tightness or looseness of the kingpin and/or truck itself.

As illustrated in FIGS. 1-7, in one embodiment, base plate 22 and/or hanger 24 can comprise one or more protrusions (or pins) 36, 38 that extend outwardly from a respective surface of base plate 22 and/or hanger 24. Although shown in FIGS. 1-7 as including two protrusions, each of base plate 22 and/or hanger 24 can include at least one and/or up to about 10 or more protrusions. Base plate and hanger protrusions 36, 38 can be operable to at least partially penetrate compressible member 26 when base plate 22, compressible member 26, and hanger 24 are fastened together via kingpin 28, as described above. When base plate 22 and hanger 24 each comprise at least two protrusions 36*a,b* and 38*a,b*, respective base plate 36*a,b*, and hanger 38*a,b* protrusions can be positioned on generally opposite sides of kingpin 28, as generally depicted in FIGS. 1-7.

Figure 3:
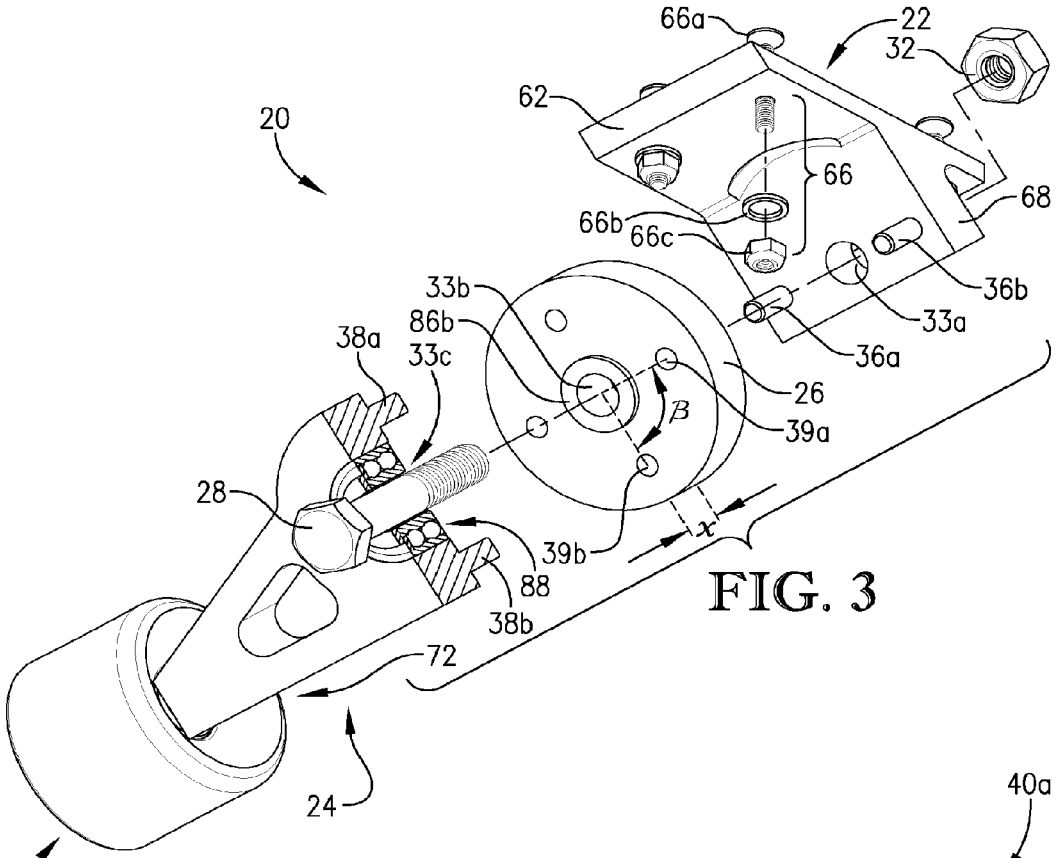
FIG. 3 is a perspective assembly view of a skateboard truck with the bearing member and hanger shown in section.
Figure 4:
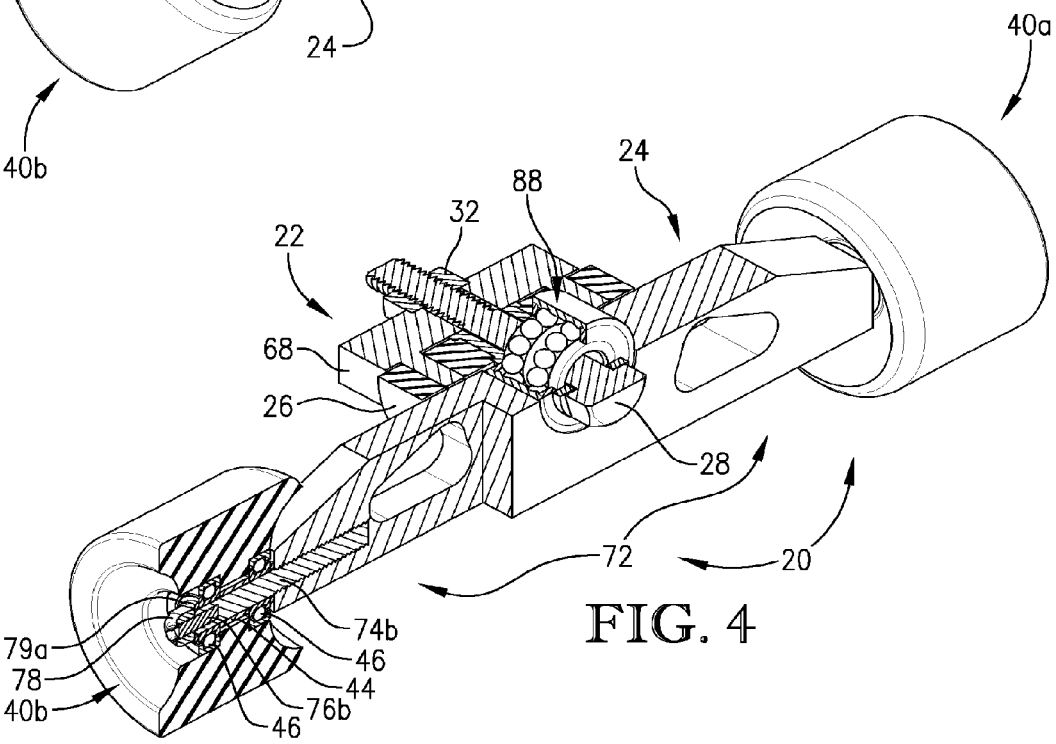
FIG. 4 is a sectional isometric view of the truck depicted in FIG. 3, taken from the opposite side.

To facilitate penetration by base plate and hanger protrusions 36, 38, compressible member 26 can define at least two openings, spaced from apart from each other by an offset angle (β), of which at least one opening (e.g., opening 39*a*) can be configured to receive a base plate protrusion (e.g., base plate protrusion 36*b*), while at least one of the other openings (e.g., opening 39*b*) can be configured to receive a hanger protrusion (e.g., hanger protrusion 38*b*), as particularly illustrated in FIG. 3. The offset angle defined between adjacent pins, which can also correspond to the relative orientations of base plate and hanger protrusions 36 and 38 when truck 20 is fully assembled, can be in the range of from about 45° to about 180°, about 75° to about 115°, about 85° to about 105°, or can be approximately 90°, as shown in FIG. 3. According to one embodiment, at least one of base plate protrusions 36 and at least one of hanger protrusions 38 can partially or fully penetrate the width of compressible member 26, such that at least one theoretical plane can be defined that is orthogonal to kingpin 28 and intersects at least one base plate protrusion 36 and at least one hanger protrusion 38. In some embodiments, such a theoretical plane can be orthogonal to kingpin 28 and intersect each of base plate protrusions 36*a,b* and hanger protrusions 38*a,b*, as generally illustrated by dashed line 82 in FIG. 6. In one embodiment, one or more (or all) of protrusions 36*a,b* and 38*a,b* can fully penetrate the entire width of compressible member 26.

Many conventional skateboard trucks utilize a back-and-forth or "rocking" motion of the kingpin and/or truck in order to facilitate motion of the skateboard. In one embodiment of the present invention, truck assembly 20 depicted in FIGS. 1-7 is configured to allow hanger 24 to rotate about one or more truck components in order to cause non-straight line (or turning) motion of a skateboard. In particular, hanger 24 can be configured to at least partially rotate about an axis that can be defined by (or is substantially parallel to) the longitudinal axis of kingpin 28, depicted as dashed line 84 in FIG. 6. In further contrast to traditional skateboard trucks, truck assembly 20 does not include cam stops to limit the rotation of hanger 24. Accordingly, hanger 24 can have a maximum degree of rotation of at least about 15°, at least about 20°, at least about 30°, at least about 35°, at least about 40°, at least 45°, at least 75°, or at least 90°.

In some embodiments, truck assembly 20 may be configured to rotate in a near frictionless manner, in order to facilitate smooth and efficient turning motion of skateboard 10. In one embodiment, near frictionless operation of truck assembly 20 can be at least partly accomplished by preventing direct contact of base plate 22, compressible member 26, and hanger 24 with one another. For example, in one embodiment, this can be accomplished by creating gaps between base plate 22 and compressible member 26 (shown as gap 87 *a* in FIG. 6) and/or between compressible member 26 and hanger 24 (shown as gap 87 *b* in FIG. 6) by employing one or more spacers between the above-listed components or by any other suitable means. As illustrated in the embodiment depicted in FIG. 6, truck assembly 20 can include one or more base plate spacers 86*a* operable to maintain a gap between base plate 22 and compressible member 26 and/or one or more hanger spacers 86*b* operable to maintain a gap between hanger 24 and compressible member 24. By avoiding contact with base plate 22 and hanger 24, compressible member 26 can be deformed and/or returned to its resting state as needed during rotation, thereby minimizing friction. Further, near frictionless motion of hanger 24 can also be facilitated by including at least one bearing member positioned within kingpin opening 33*c* of hanger 24 to surround kingpin 28, as particularly shown in FIGS. 3 and 4. The bearing member can be any suitable type of bearing and, in one embodiment can comprise a ball bearing set or a double row ball bearing set, illustrated as double row ball bearing set 88 in FIGS. 1-7. Additional details regarding the operation of truck assembly 20, particularly related to its use with a skateboard 10, will now be discussed in detail with reference to FIGS. 8-14.

Figure 7:
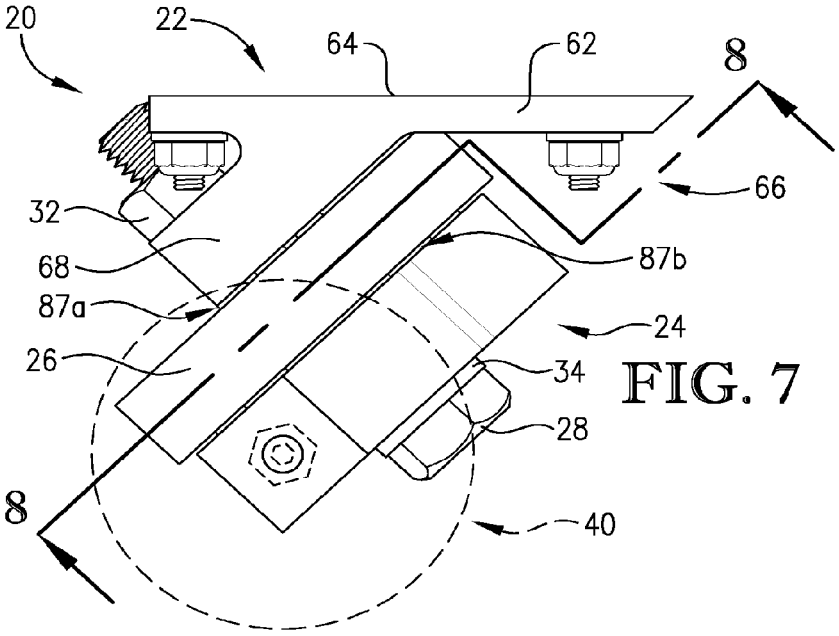
FIG. 7 is a side elevation view of a front truck with a wheel shown in phantom.
Figure 8:
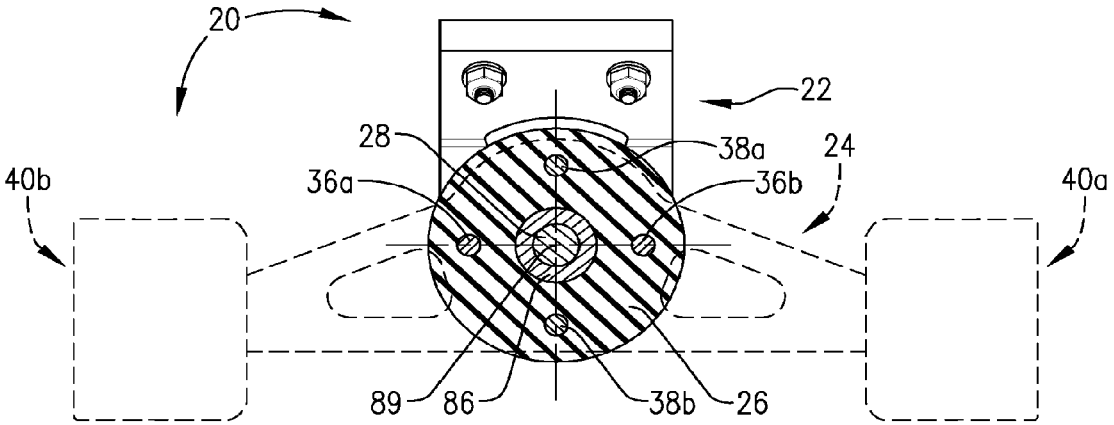
FIG. 8 is a rear sectional view taken from the section line B-B' depicted in FIG. 7, particularly illustrating the position of the compressible member when the hanger is configured in a resting position.
Figure 9:
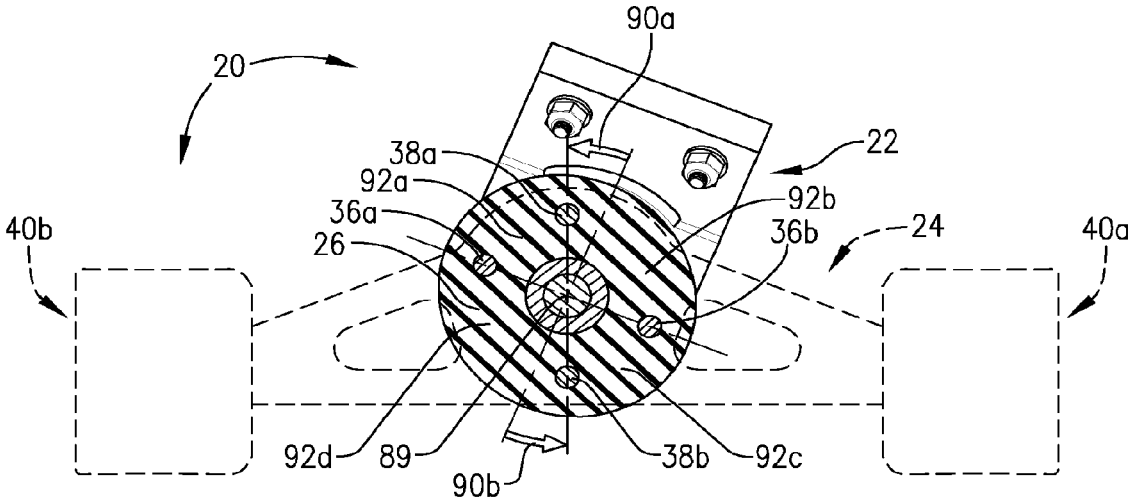
FIG. 9 is a rear sectional view taken from the section line B-B' depicted in FIG. 7, particularly illustrating the position of the compressible member when the hanger is configured in a turning position.

Turning first to FIGS. 8 and 9, cross-sectional views of a truck assembly 20 taken along line B-B' in FIG. 7 is provided. In particular, FIG. 8 illustrates hanger 24 of truck assembly 20 in a resting position, while FIG. 9 illustrates hanger 24 in a turning position.

In operation, hanger 24 can be transitioned between the resting and turning positions respectively shown in FIGS. 8 and 9, by at least partially rotating hanger 24 about an axis of rotation, depicted as axis 89 in FIGS. 8 and 9. When hanger 24 is positioned in a resting position, the internal forces (e.g., compression and/or tension forces) within compressible member 26 can be in relative equilibrium. However, when hanger 24 is rotated away from a resting position into a turning position, as generally shown in FIG. 9, at least one of the pair of hanger protrusions 38*a,b* and/or base plate protrusions 36*a,b* change position, as indicated by arrows 90*a* and 90*b*, while the other pair remains substantially stationary. As a result, compressible member 26 at least partially deforms, and one of the pins from pair 36*a,b* and one of the pins from pair 38*a,b* move closer together (e.g., pins 36*a* and 38*a* in FIG. 9), while one of the pins from pair 36*a,b* and one of the pins from pair 38*a,b* move further apart (e.g., pins 36*a* and 38*b*). As a result, alternating zones of compression (e.g., zones 92*a,c*) and tension (e.g., zones 92*b,d*) are created within compressible member 26, as generally illustrated in FIG. 9. As kingpin 28 is rotated back to its starting position, the zones of compression 92*a,c* and tension 92*b,d* can be operable to cooperatively urge hanger 24 back to its resting position, thereby restoring force equilibrium within compressible member 26, as shown in FIG. 8.

Figure 11:
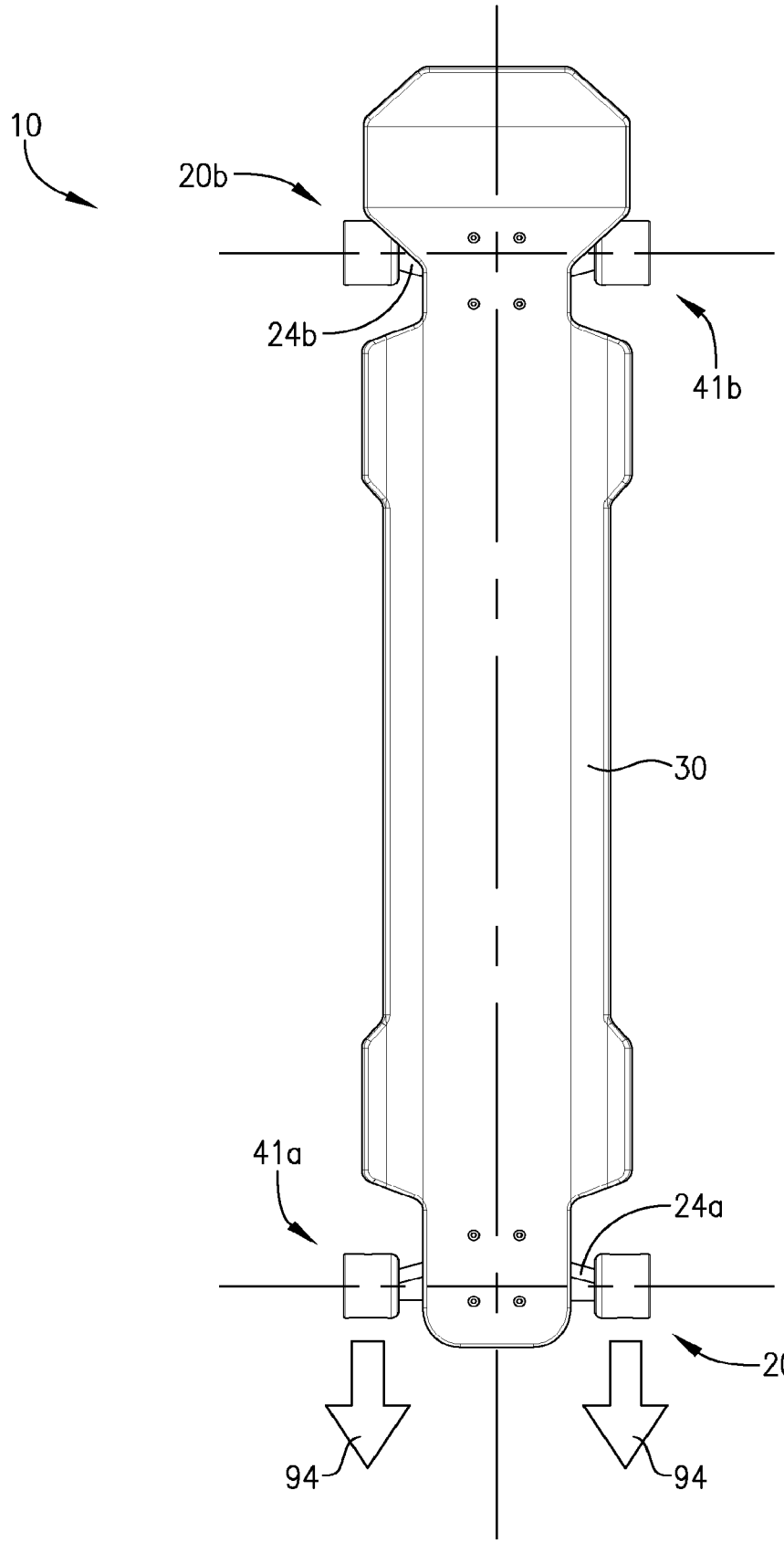
FIG. 11 is top elevation view of a skateboard, particularly illustrating a typical aligned (straight) path of travel.
Figure 12:
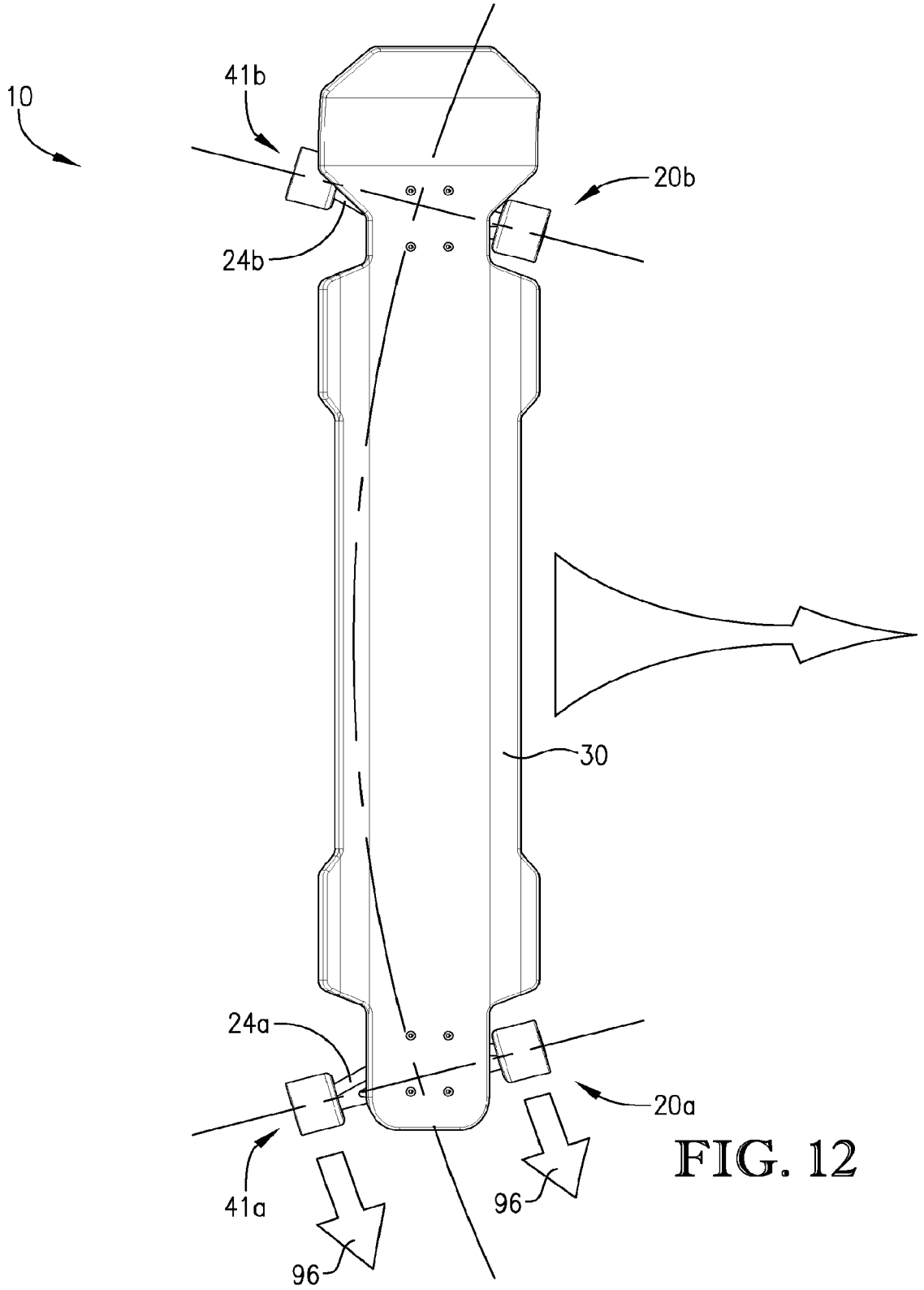
FIG. 12 is a top elevation view of a skateboard, particularly illustrating the result of an applied force on the direction of travel of the skateboard.
Figure 13:
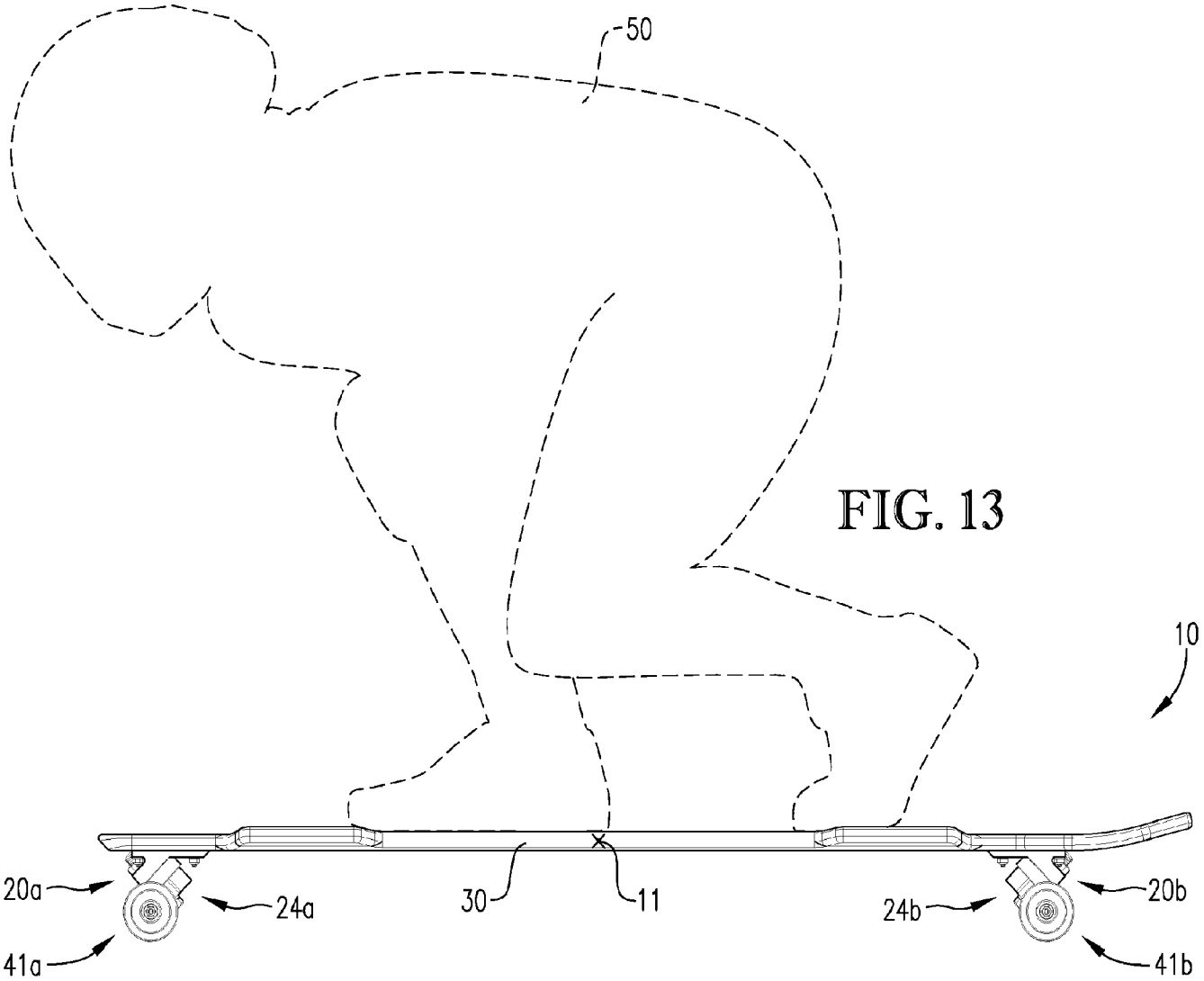
FIG. 13 is an environmental side elevation view of a rider on a skateboard that comprises one or more inventive truck assemblies.

Referring now to FIGS. 9-14, a skateboard 10 configured according to one or more embodiments of the present invention is provided. Skateboard 10 is generally illustrated as comprising a front and a rear truck assembly 20*a,b*, configured for operation as described above, for fastening two pairs of wheel assemblies 41*a,b* to a skate deck 30. As shown in FIG. 13, front and rear truck assemblies 20*a,b* can be oriented such that the long axes of respective front and rear kingpins (not depicted in FIG. 13) can be aligned toward the center point of skateboard 10, shown as center point 11 in FIG. 13. In some embodiments, skate deck 30 can be a standard deck having a length in the range of from about 24 to about 36 inches, or from about 28 to about 36 inches, while in other embodiments, skate deck 30 can be a longboard deck having a length in the range of from about 37 to about 70 inches, about 40 to about 65 inches, or about 42 to about 48 inches. Deck 30 can have a variety of widths and/or thicknesses and can be constructed of any suitable material in any desirable shape or profile.

Figure 5:
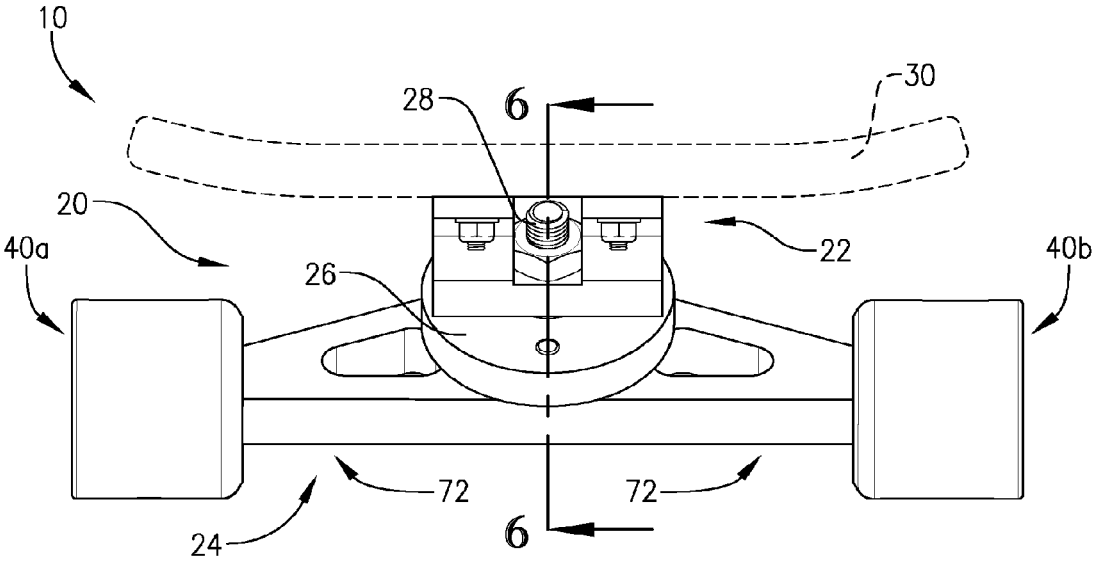
FIG. 5 is a front elevation view of a front truck with the deck shown in phantom.
Figure 6:
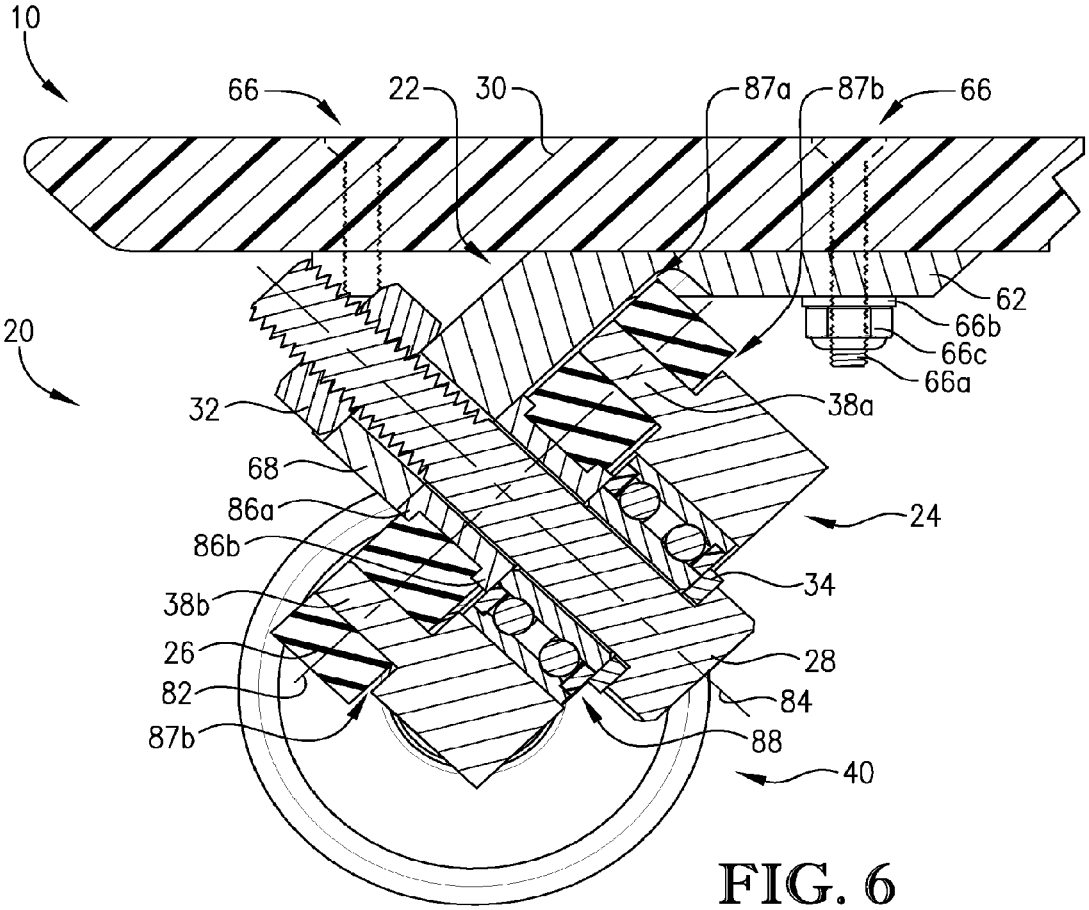
FIG. 6 is a partial section view taken along line A-A' from the center location of the truck as shown in FIG. 5.
Figure 10:
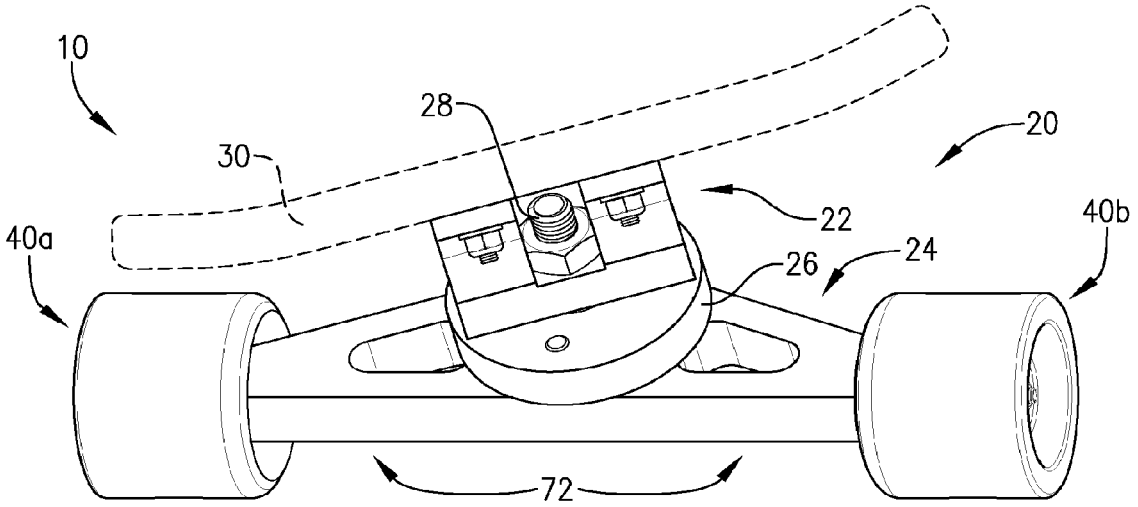
FIG. 10 is a front elevation view of a skateboard as depicted in FIG. 5, particularly illustrating the change in position of the truck as the result of an applied force.
Figure 14:
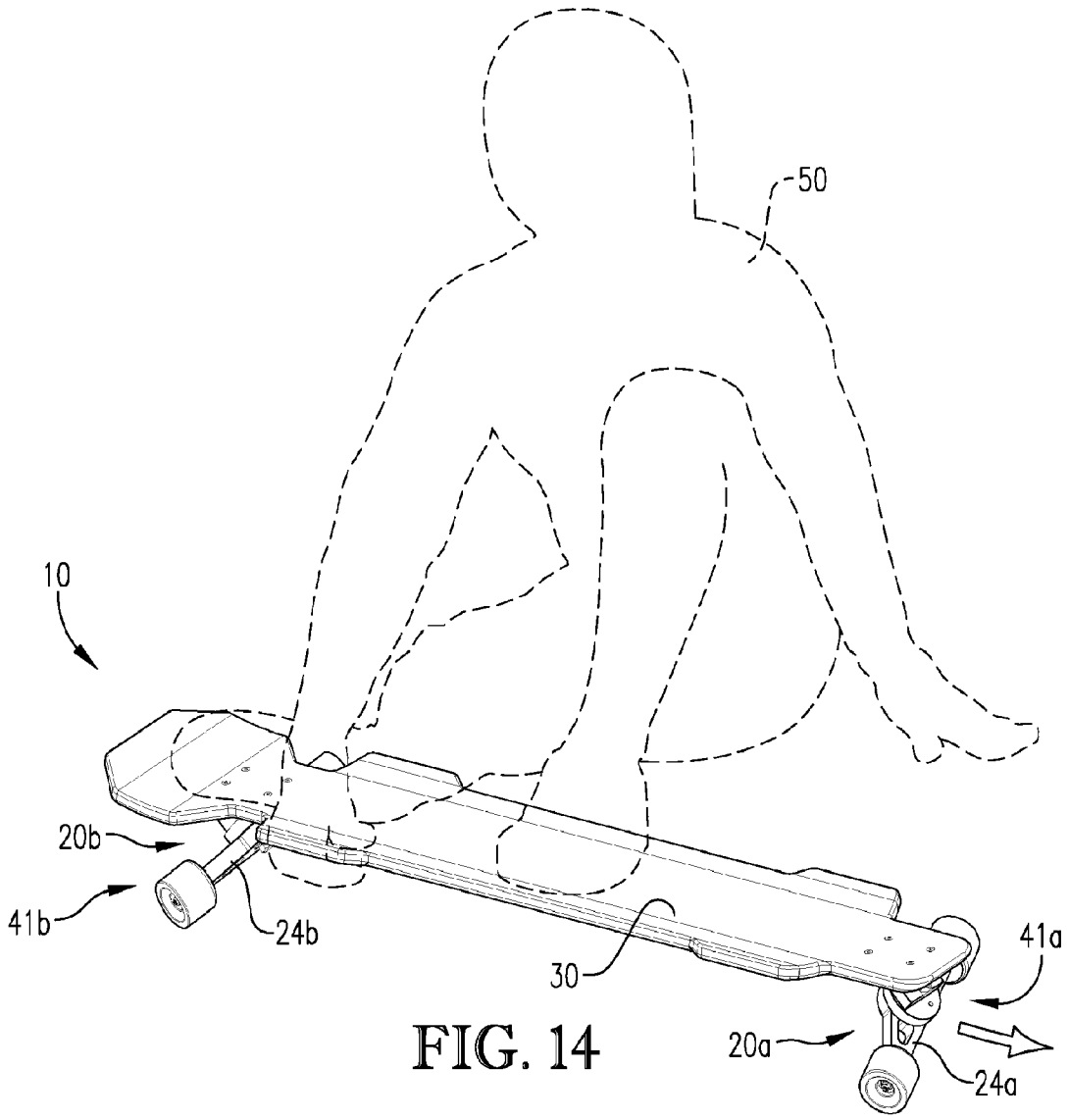
FIG. 14 is an environmental prospective view of the rider on the skateboard shown in FIG. 13.

As shown in FIGS. 9-14, each of front and rear trucks 20*a,b* of skateboard 10 can include a respective front and rear hanger 24*a,b*, which can be configured to transition respective hangers (not shown) between a resting and a turning position as previously described with respect to FIGS. 8 and 9, in order to turn skateboard 10 from a generally aligned (straight) path of travel, as depicted by arrows 94 in FIG. 11, to an altered (directional) path of travel, as depicted by arrows 96 in FIG. 12. In operation, rider 50, depicted in FIG. 13, can turn skateboard 10, by exerting a downward force toward one side of skate deck 30 (usually by shifting his or her weight in some manner, as generally depicted in FIG. 14), thereby depressing that side of skate deck 30 and at least partially causing the rotation of hanger 24, as illustrated in FIG. 10. As a result, each of the hangers can shift into a turning position, with the front hanger rotating in one direction and the back hanger rotating in a similar, but generally opposite, direction. Consequently, the axles of front and rear trucks 20*a,b* can also rotate in a similar, but generally opposite, direction, thereby shifting the path of travel of (e.g., turning) skateboard 10, as shown in FIGS. 12 and 14. Once the turn is complete, rider 50 can re-position his or her weight, straightening deck 30, which returns the front and rear hangers of truck assemblies 20*a,b* back to a resting position, as generally shown in FIG. 5, and returns skateboard 10 to an aligned (straight) path of travel, as shown in FIG. 11. In some embodiments, the use of one or more truck assemblies, as described herein, can provide rider 50 of skateboard 10 with additional flexibility and performance, while still maintaining a desired degree of stability and safety.

The preferred forms of the invention described above are to be used as illustration only, and should not be used in a limiting sense to interpret the scope of the present invention. Obvious modifications to the exemplary one embodiment, set forth above, could be readily made by those skilled in the art without departing from the spirit of the present invention. The inventor hereby state his intent to rely on the Doctrine of Equivalents to determine and assess the reasonably fair scope of the present invention as pertains to any apparatus not materially departing from but outside the literal scope of the invention as set forth in the following claims.

The invention claimed is:

1. A truck assembly comprising:

a base plate configured to be mounted to a deck, the base plate comprising:

a mounting plate configured to interface with the deck, and an angled hanger coupling member extending from the base plate and comprising at least one base plate protrusion extending outwardly from the angled hanger coupling member;

a hanger configured to at least partially rotate about an axis between a resting position and a turning position, the hanger comprising:

a first surface and a second surface, wherein at least the first surface is configured to face the angled hanger coupling member of the base plate, and at least one hanger protrusion extending outwardly from the first surface of the hanger;

at least one base plate spacer adjacent to the angled hanger coupling member; and at least one hanger spacer adjacent to the first surface of the hanger;

wherein the at least one base plate protrusion and the at least one hanger protrusion are configured to engage at least one compressible member such that a first gap is formed between the at least one compressible member and the angled hanger coupling member by the at least one base plate spacer, and such that a second gap is formed between the at least one compressible member and the first surface of the hanger by the at least one hanger spacer.

2. The assembly of claim 1, wherein a kingpin is configured for assembly of the truck assembly, wherein the kingpin orthogonally intersects at least the first surface and/or the second surface of the hanger.

3. The assembly of claim 2, wherein the axis is defined by a longitudinal axis of the kingpin.

4. The assembly of claim 3, wherein the hanger defines therein a kingpin opening configured to receive the kingpin.

5. The assembly of claim 1, wherein the at least one compressible member is comprised of an elastomer.

6. The assembly of claim 5, wherein the elastomer has a Shore A hardness in the range of from about 60 to about 110.

7. The assembly of claim 1, wherein when the hanger is rotated away from the resting position, at least one compression zone and at least one tension zone are created about a plane in the at least one compressible member, and further wherein the at least one compression zone and the at least one tension zone cooperatively urge the hanger to return to the resting position.

8. The assembly of claim 1, wherein the angled hanger coupling member protrudes from the mounting plate at an angle in the range of from about 15° to about 75°.

9. The assembly of claim 1, wherein the hanger has a maximum degree of rotation of at least 15°.

10. The assembly of claim 1, wherein the at least one base plate spacer and the at least one hanger spacer are configured to maintain the first gap and the second gap when the hanger is rotated away from the resting position.

11. The assembly of claim 1, wherein the hanger presents a pair of opposing axle pins, wherein the pins are hardened and ground.

12. A hanger for a truck assembly configured to at least partially rotate about an axis between a resting position and a turning position, the hanger comprising:

a first surface and a second surface, wherein at least the first surface is configured to face an angled hanger coupling member of a base plate; and at least one hanger protrusion extending outwardly from the first surface of the hanger, wherein the at least one hanger protrusion is configured to fully penetrate a width of at least one compressible member that is spaced apart from the first surface of the hanger by at least one hanger spacer, such that a gap is created between the at least one compressible member and the first surface of the hanger.

13. The hanger of claim 12, wherein when the hanger is rotated away from the resting position, at least one compression zone and at least one tension zone are created about a plane in the at least one compressible member, and wherein the at least one compression zone and the at least one tension zone cooperatively urge the hanger to return to the resting position.

14. The hanger of claim 12, wherein a kingpin is configured for assembly of the truck assembly, and wherein the kingpin orthogonally intersects at least the first surface and/or the second surface of the hanger.

15. The hanger of claim 14, wherein the axis is defined by a longitudinal axis of the kingpin.

16. The hanger of claim 12 further comprising a kingpin opening configured to receive a kingpin, the kingpin opening having at least one bearing member for facilitating rotation of the hanger about the kingpin.

17. The hanger of claim 16, wherein the at least one hanger spacer is configured to be interposed directly between the at least one compressible member and at least the first surface of the hanger.

18. A base plate for a truck assembly, the base plate comprising:

a mounting plate; and an angled hanger coupling member extending from the base plate and comprising at least one base plate protrusion extending outwardly from the angled hanger coupling member, wherein the at least one base plate protrusion is configured to penetrate at least half of a width of at least one compressible member that is spaced apart from the angled hanger coupling member by at least one base plate spacer, such that a gap is created between the at least one compressible member and the angled hanger coupling member.

19. The base plate of claim 18, wherein the at least one compressible member is primarily comprised of an elastomer.

20. The base plate of claim 19, wherein the elastomer has a Shore A hardness in the range of from about 60 to about 110.

* * * * *